US006001490A

United States Patent [19]

Rienäcker et al.

[11] Patent Number: 6,001,490

[45] Date of Patent: Dec. 14, 1999

[54] SINGLE-SIDED IMPREGNATED PRINTING PAPER CARRIERS

[75] Inventors: Klaus Rienäcker; Bernd Reinhardt, both of Osnabrück; Heinrich Hörnschemeyer; Reinhard Janssen, both of Wallenhorst, all of Germany

[73] Assignee: Kämmerer GmbH, Osnabruck, Germany

[21] Appl. No.: 09/056,944

[22] Filed: Apr. 8, 1998

[30] Foreign Application Priority Data

Apr. 12, 1997 [DE] Germany ..... 197 15 268
Sep. 16, 1997 [DE] Germany ..... 197 40 638

[51] Int. Cl.[6] ..... B32B 27/06

[52] U.S. Cl. ..... 428/480; 428/511; 428/530; 428/537.5

[58] Field of Search ..... 428/480, 201, 428/172, 511, 530, 537.5, 153; 162/135, 134; 156/288, 307.4

[56] References Cited

U.S. PATENT DOCUMENTS

| | | | |
|---|---|---|---|
| 4,044,185 | 8/1977 | McCaskey, Jr. | 428/153 |
| 4,207,379 | 6/1980 | Fock et al. | 428/480 |
| 4,374,886 | 2/1983 | Raghava | 428/172 |
| 5,462,788 | 10/1995 | Ohashi et al. | 428/201 |
| 5,753,077 | 5/1998 | Horand et al. | 162/135 |

FOREIGN PATENT DOCUMENTS

| | | |
|---|---|---|
| 11 87 120 | 2/1965 | Germany . |
| 24 24 471 | 12/1974 | Germany . |
| 27 27 312 | 12/1978 | Germany . |
| 35 03 666 | 10/1985 | Germany . |
| 54-030263 | 3/1979 | Japan . |
| 61-097498 | 5/1986 | Japan . |
| 61-249747 | 11/1986 | Japan . |
| 1 455 461 | 11/1976 | United Kingdom . |

OTHER PUBLICATIONS

Reinhardt B., *Wochenblatt Fur Papierfabrikation*, pp. 198–205 (Nov. 6, 1992).

*Primary Examiner*—Timothy Speer
*Attorney, Agent, or Firm*—Amster, Rothstein & Ebenstein

[57] ABSTRACT

A thin film with improved surface properties in terms of its ability to be lacquered, printed and laminated made of non-beater sized paper contains a pigment coating on the printing or lacquering side and is impregnated with impregnating resins starting from the side opposite the pigment coating.

11 Claims, No Drawings

SINGLE-SIDED IMPREGNATED PRINTING PAPER CARRIERS

BACKGROUND, SUMMARY AND DESCRIPTION OF THE INVENTION

The invention relates to single-side pigment-coated thin films based on preimpregnates.

Decorative films with a surface finish are decorative surface materials for chipboard and MDF (medium density fibre) board in furniture making. Said decorative films are synthetic resin impregnated or synthetic resin impregnated and subsequently surface-treated, decoratively printed or unprinted paper webs in a state which can no longer be reactivated under pressure and heat. Depending on the type of impregnation process, a distinction is made between thermosetting decorative films with a through-impregnated core (off-line process) and decorative films based on pre-impregnates (on-line process), on which a finish coating may then be carried out. This produces a decorative film having a fully finished surface.

Decorative films based on preimpregnates are already impregnated to a greater or lesser depth with a resin mixture within the paper machine, immediately after sheet formation, depending on the mass per unit area of the base paper. After drying, the paper or film must be resistant to splitting so that no fibre separation occurs within the decorative film during the subsequent processing stages of finish coating and laminating onto appropriate supports.

The desired opacity, color and optionally light fastness of said preimpregnates is achieved by adding large quantities of white pigments to the paper pulp.

Preimpregnates or decorative films with a mass per unit area of between 20 and 80 g/m$^2$ are referred to as thin films. These thin films are mostly characterised by good flatness and can therefore be laminated without difficulty, whereas their ability to be printed with water-based or solvent-based gravure inks satisfies only average requirements in view of the limited smoothing properties due to the synthetic resin content.

Also known are non-impregnated thin films, so-called Japanese paper with a mass per unit area of between 20 and 50 g/m$^2$ which are increasingly being used as decorative surface materials.

In contrast to preimpregnates, said white or colored paper contains only small proportions of pigments, if any, and therefore has only a low opacity in the untreated state. As a result, it is limited in its ability to mask sufficiently the surface of chipboard or MDF board. Said Japanese papers have very good internal strength and single-side smoothness, these properties making them very receptive to gravure printing and lacquering. On the other hand, said Japanese paper which are not impregnated with synthetic resins but only treated on the surface with an unpigmented polymer film have a very strong tendency to curl at the edges during the laminating process using mostly waterbased adhesives. In the generally conventional continuous process using roller laminating machines, said paper can therefore be fixed to chipboard and MDF board and dried only with difficulty. The board thus covered, however, can then be machined just as easily as when preimpregnates are used since the laminated paper exhibits only short edge tear back.

The object of the invention was, therefore, to provide thin films with the lowest possible mass per unit area which have sufficient laminar strength and good flatness and can be roller-laminated equally well or even more quickly with waterbased adhesives but are additionally characterised by very good gravure printing and lacquering properties. Moreover, the thin films with a comparable mass per unit area should have greater light fastness and opacity, if possible, than conventional Japanese paper and better strength properties than known preimpregnates.

The object is achieved by a thin film which has been provided on the upper side, the printing or lacquering side, with a pigment coating and is impregnated starting from the underside, the laminating side, with a resin.

To prepare the thin films according to the invention, pulp fibre mixtures with high absorbency and strength are used, for example, those made from eucalyptus pulp and pine wood sulphate pulp. A beater sizing is not required in each case, and the pulp fibre mixtures may contain white or colored pigments, depending on the desired application.

The pigment coating formed on one side of the thin film has a thickness of 1 to 8 g/m$^2$, for example 3, 5 or 7 g/m$^2$. The pigment to binder ratio in the pigment coating is preferably 1:0.05 to 1:2 and in a particularly preferred embodiment 0.005 to 1:2 or 1:0.08 to 1:0.35 based on the solids content.

For the preparation of the pigment coating white pigments such as clay, calcium carbonate, aluminium hydroxide, talc or titanium dioxide or color pigments such as iron oxide pigments, carbon black, copper, aluminium, other metal pigments, or organic color pigments alone or in mixture, optionally fluid dyes are added. The pigment coating may contain natural or synthetic binders such as starch, polyvinyl alcohol, carboxymethylcellulose, polymer latices on the basis of acrylic acid, acrylic acid ester, styrene, butadiene or vinyl acetate acryle nitrile. According to a preferred embodiment the pigment coating contains 1 to 10 parts by weight based on the amount of pigment of melamine resin, urea resin or phenolic resin or glyoxal resin. Conventional crosslinking agents and penetration aids may be included in the pigment coating.

The pigment coating must have barrier properties with respect to aqueous or solvent-containing substances, such as lacquers and printing inks. In order to obtain good smoothing properties and hence sufficient barrier properties with the thinnest possible pigment coatings, pigments in flake form are particularly preferred, such as clay, aluminium hydroxide or talc. It is also possible, however, to satisfy these properties in large measure by way of a suitable choice of the type and proportion of binders in the pigment coating.

Lowering the mass per unit area of the single-side pigment-coated thin films according to the invention does, however, put limits on the strength and covering power (opacity). On the one hand, the opacity may be increased by adding opacity-increasing, light-fast white or colored pigments to the fibrous material, but at the same time this has an adverse effect on the paper strength. The addition of dry and wet strength agents may offset to a certain extent this adverse effect on the paper strength. On the other hand, during the production of colored paper, it is readily possible to replace said pigments wholly or partially by aqueous dyes with a lower light fastness since the pigment coating is able to reduce the disadvantage of lower light fastness of such colored paper. The desired color of the paper is achieved without sacrificing strength by adding, for example, anionic or cationic direct dyes to the fibrous material, but the opacity and light fastness are improved at the same time by the single side pigment coating.

Aqueous polymer dispersions on the basis of the above mentioned monomers and melamin, urea or phenolic resins as well as mixtures therof with polymer dispersions are used for impregnation of the paper. By the addition of a portion of at most about 10 parts by weight (solid) of pigments to the impregnation liquid opacity of white pre-impregnates still may be increased. Resin uptake may amount to 5 to 30% wt. based on the weight of the base paper, preferably 5 to 15% wt.

Moreover, other auxiliaries may be added to the impregnating mixtures, such as wetting agents, viscosity regulators, anti-adhesion agents and penetrating agents, pigments, dyes and defoamers.

The pigment coating may be applied preferably by means of the so-called thin layer technology within the paper machine onto the base paper. Discribed is this technology in "Das Papier, 1991, volume 10 A, pp V120–124, Wochenblatt für Papierfabrikation, 1993, volume 10, pp 390–393 and 1994, volume 17, pp 671–676".

The so-called differential coating method described in "Wochenblatt für Papierfabrikation (1992), no. 6, pp 198–205" has proved to be particularly advantageous for the preparation of the thin films according to the invention. When this coating technology is used, a thin pigment coating is applied to one side of the paper web according to the invention using the thin layer technology mentioned above, and impregnation of the other side of the paper takes place at the same time in the roller nip (sump development).

The paper structure is altered by impregnation in a measurable manner in terms of its elasticity and brittleness/flatness, depending on the subsequent processing requirements. Moreover, the reverse side of the paper impregnated according to the invention should ensure a rapid and firm bond with the chipboard or MDF board to be laminated. This is only possible if the adhesive force and viscosity of the waterbased adhesives are tailored precisely to the surface properties of the chipboard and, above all, the furniture film. The physical and chemical nature of the surface of the thin decorative film may make an important contribution to this.

The impregnated and surface-pigmented thin films according to the invention may be smoothed on one side, on-line smoothing with a soft calender or machine calender having proved particularly advantageous for maintaining the opacity of the paper.

The single-side pigment-coated thin films according to the invention have good flatness and laminar strength and, on the pigment-coated side, have very good printing and lacquering properties. The reverse of the paper impregnated with synthetic resins permits rapid, problem-free bonding to fibreboard.

The thin film according to the invention is also suitable for other applications in which paper supports with excellent single-side printing properties or ability to be coated with waterborne or solvent-based media are desired, and where the reverse of the paper is also required to have very good bonding or laminating properties with different substrate materials. Wall linings, poster materials and special masking papers for packaging may be mentioned as examples.

The following examples further explain the invention. All quantities are related to the solid or solid content unless indicated otherwise.

EXAMPLE 1

A light-brown raw paper, 45 g/m$^2$, with a fibre composition of 80% eucalyptus pulp and 20% pine sulphate pulp without beater sizing and with a filler input of 25 kg of titanium dioxide per ton pulp was prepared on an approximately 2.30 m wide paper machine with a machine speed of 400 m/min, and coated on one side with a clay pigment coating with a high binder content of 3 to 4 g/m$^2$ on a twin-roll coater (film press) using the differential coating method, and impregnated on the reverse with a synthetic resin mixture of acrylate-latex and urea resin. The resin uptake was about 10% based on the raw paper weight. The paper was then smoothed on one side on the pigment-coated side on a pilot scale soft calender. The resulting properties of the paper according to the invention are compared with the paper properties of conventional Japanese films and preimpregnates of comparable mass per unit area and color.

In the laboratory test in comparison with conventional furniture preimpregnates of 53 g/m$^2$, the single-side pigment-coated thin film according to the invention based on preimpregnate of 45 g/m$^2$ resulted in better printing properties in gravure printing and higher gloss after lacquering with aqueous acrylic lacquer (9 g/m$^2$ lacquer application) on the pigmented upper side of the paper, and more rapid absorption of the waterborne laminating adhesives (based on acrylate or urea) on the reverse of the paper (see also water absorption values). It can be concluded from this that the paper according to the invention has better fibreboard bonding/laminating properties. The somewhat worse flatness is not likely to have any adverse effects during the laminating process. Masking of the fibreboard, on the other hand, is somewhat worse in view of the lower ash content and the slightly lower opacity associated with this. Moreover, the light fastness is worse.

In comparison with conventional Japanese films, the thin film according to the invention exhibits slightly better printing properties in gravure printing, a markedly better lacquer stability and more rapid absorption of the adhesive on the reverse of the paper (improved bonding/laminating properties).

Moreover, the masking of the fibreboard is better in view of the somewhat higher opacity of the paper according to the invention. The light fastness is slightly better compared with conventional Japanese film because of the surface pigmentation.

EXAMPLE 2

In a similar manner to Example 1, a white (bleached) raw paper of 47 g/m$^2$ with a fibre composition of 80% eucalyptus and 20% pine sulphate pulp and with a filler input of 50 kg of titanium dioxide per t of fibre was prepared on the paper machine and coated on one side with a pigment coating (clay) using the differential coating method, in a similar manner to Example 1, and impregnated on the reverse.

The paper was then smoothed on line using a soft calender.

EXAMPLE 3

In a similar manner to Example 1 and 2, a white (bleached) raw paper of 80 g/m$^2$ with a fibre composition of 80% eucalytpus and 20% pine sulphate pulp and with a filler input of 250 kg of clay and 50 kg of talc per t of fibre was prepared on the paper machine. Unlike the papers according to Examples 1 and 2, the pulp was fully beater-sized (resin sizing) in order to limit the penetration into the paper structure of the impregnating and coating compositions applied afterwards by means of the differential coating method.

In contrast to Examples 1 and 2, the single-side pigment coating of the paper web was carried out with a mixture of acrylate-latex and urea resin in a ratio of 70:30 (solid), to which 20% titanium dioxide were added, based on the total quantity of latex/urea resin (solid).

The reverse of the paper web, on the other hand, was partially impregnated with a latex/synthetic resin mixture similar to Examples 1 and 2. The impregnating resin uptake was consequently only 5% of the raw paper weight.

This single-side, lightly pigmented paper based on pre-impregnate known as printing base paper was compared with the single-side pigment-coated thin film impregnated on the reverse according to the invention similar to Example 2, and with conventional 45 g/m$^2$ Japanese papers and with furniture preimpregnates of 53 g/m$^2$.

Again, the single-side pigment-coated thin film according to the invention based on preimpregnate proved to be qualitatively superior to the other papers in terms of the following characteristic features:

best printing properties in gravure printing highest lacquer stability most rapid absorption of the laminating adhesive on the reverse of the paper, i.e. best properties in terms of ability to be bonded to/laminated with other materials.

On the other hand, the opacity and light fastness are worse compared with conventional preimpregnates and the printing base paper.

With regard to opacity, reference must be made to the influence of the higher mass per unit area of the printing base paper.

The thin film according to the invention therefore combines both the positive properties of conventional preimpregnates with those of Japanese papers.

EXAMPLE 4

In a similar manner to example 1 a light-brownish colored raw paper having an area weight of approximately 45 g/m$^2$ was prepared whereby the paper was not colored with a liquid dye but rather with pigments on the basis of iron oxide.

In contrast to examples 1 to 3 the single side pigment coating of the paper web was carried out with a mixture of styrene/butadiene-latex and urea resin in a ratio of 25:75 (solid), to which twice the amount of clay (solid) were added, based on the total quantity of latex/urea resin (solid).

The reverse of the paper web, on the other hand, was impregnated with the same latex/synthetic resin mixture as used in examples 1 to 3. The impregnating resin uptake was 30% of the raw paper weight.

In comparison to the papers that were prepared according to examples 1 and 2 the paper exhibited a better light fastness (great 3–4), higher opacity (93%) and higher brittleness with the carrying resistance being lower by approximately 30%.

EXAMPLE 5

In a similar manner to example 4, a colored raw paper having a mass per unit of 45 g/m$^2$ was prepared.

In contrast to example 4, the single-side pigment coating of the paper web was carried out with a mixture of acrylatex and urea resin in a ratio of 90:10 (solid), to which approximately twice the amount of clay (solid) was added. The reverse of the paper web was impregnated with the same latex/synthetic resin as in examples 1 and 2.

The uptake of resin was approximately 10% of the weight of the raw paper.

In comparison to the papers prepared according to examples 1, 2 and 4 the product exhibited a slightly better printability and paintability as well as a higher elasticity.

| | | Sample 1 | | |
|---|---|---|---|---|
| Property<br>Color: light-brown | Unity | Paper accord. to invention (average value) | Preim-pregnate (average value) | Japanese paper |
| Mass per unit | g/m$^2$ | 45 | 53 | 45 |
| Thickness | μm | 45 | 57 | 52 |
| Raw density | g/cm$^3$ | 1.000 | 0.940 | 0.865 |
| Breaking length | | | | |
| lengthwise | km | 8.5 | 7.5 | 11.6 |
| crosswise | | 6.5 | 4.2 | 7.0 |
| Tearing resistance (Elmendorf) | | | | |
| lengthwise | mNm$^2$/g | 8.9 | 7.2 | 10.9 |
| crosswise | | 9.3 | 7.6 | 16.5 |
| Smoothness (Bekk) Upper side | s | 500 | 400 | 414 |
| Mikro-roughness Upper side (Parker Print Surf) | μm | 2.5 | 3.5 | 2.47 |
| Porosity (Bendtsen) | ml/min | <5 | 70 | 210 |
| Water absorption (Cobb-Unger) | | | | |
| Upper side | g/m$^2$ | 30 | 10 | 18 |
| Wire side | | 35 | 10 | 24 |
| Lacquer stability as gloss (75°) (aqueous coating weight about 9 g/m$^2$) | % | 75 | 66 | 35 |
| Printability (aqueous gravure color) | Note$^{1)}$ | 1 | 3 | 2 |
| Ash | % | 7 | 10 | 0.6 |
| Opacity | % | 89.0 | 96.0 | 84.0 |
| Light fastness | Note$^{2)}$ | 2 | 6 | 1 |

Note$^{1)}$1 = very good 5 = poor

Note$^{2)}$the higher the evaluation the better is light fastness

Samples 2 and 3

| Property<br>Color: bleached | Unity | Paper accord. to invention (average value) | Preimpregnate (average value) | Druckbasispapier (Durchschnittewerte) | Japanese paper |
|---|---|---|---|---|---|
| Mass per unit | $g/m^2$ | 47 | 53 | 80 | 51 |
| Thickness | $\mu m$ | 45 | 57 | 87 | 63 |
| Raw density | $g/cm^2$ | 1.040 | 0.940 | 0.920 | 0.810 |
| Breaking length | | | | | |
| lengthwise | km | 8.5 | 7.5 | 9.3 | 9.8 |
| crosswise | | 6.5 | 4.2 | 5.9 | 6.0 |
| Tearing resistance (Elmendorf) | | | | | |
| lengthwise | $mNm^2/g$ | 8.5 | 7.2 | 8.1 | 10.2 |
| crosswise | | 8.9 | 7.6 | 7.7 | 14.2 |
| Smoothness (Bekk) Upper side | s | 500 | 450 | 200 | 398 |
| Mikro-roughness Upper side (Parker Print Surf) | $\mu m$ | 2.5 | 3.5 | 3.3 | 2.7 |
| Porosity (Bendtsen) | ml/min | <5 | 70 | 100 | 180 |
| Water absorption (Cobb-Unger) | | | | | |
| Upper side | $g/m^2$ | 30 | 10 | 26 | 20 |
| Wire side | | 35 | 10 | 26 | 23 |
| Lacquer stability as gloss (75°) (aqueous coating weight about 9 $g/m^2$) | % | 75 | 66 | 54 | 34 |
| Printability (aqueous gravure color) | Note[1)] | 1 | 3 | 1 bis 2 | 2 |
| Ash | % | 10 | 20 | 10 | 0.3 |
| Opacity | % | 75.0 | 80.0 | 84.0 | 66.7 |
| Light fastness | Note[2)] | 2 | 6 | 3 | 1 |

Note[1)]1 = very good 5 = poor
Note[2)]the higher the evaluation the better is light fastness

We claim:

1. A paper film comprising a base paper coated with a pigment coating on a single side thereof and impregnated with an impregnating resin on a side opposite the side coated with the pigment coating, said impregnating resin containing not more than 10 parts by weight of a pigment and comprising a mixture of an aqueous polymer dispersion and at least one of melamine resin, phenolic resin, urea resin, and glyoxal resin, said base paper having a mass per unit area of between 20 and 80 $g/M^2$.

2. The paper film of claim 1, wherein the pigment coating has a thickness of 1 to 8 $g/m^2$.

3. The paper film of claim 1, wherein the pigment coating comprises a pigment and a binder.

4. The paper film of claim 3, wherein the pigment to binder ratio is 1:0.05 to 1:0.35.

5. The paper film of claim 3, wherein the pigment is selected from the group consisting of a white pigment, a color pigment, a metal pigment, an organic color pigment, a fluid dye, and any mixture thereof.

6. The paper film of claim 3, wherein the pigment is selected from the group consisting of clay, calcium carbonate, aluminum hydroxide, talc, titanium dioxide, an iron oxide pigment, carbon black, copper, aluminum, and any mixture thereof.

7. The paper film of claim 3, wherein the pigment is selected from the group consisting of clay, aluminum hydroxide, talc, and any mixture thereof.

8. The paper film of claim 3, wherein the binder is selected from the group consisting of starch, polyvinyl alcohol, carboxymethylcellulose, a polymer latice based on acrylic acid, an acrylic acid ester, styrene, butadiene, vinyl acetate, acryle nitrile, and any mixture thereof.

9. The paper film of claim 1, wherein the pigment coating comprises 1 to 10% wt. melamine resin, urea resin, phenolic resin, glyoxal resin, or any mixture thereof.

10. The paper film of claim 1, wherein the impregnating resin is a mixture of arylate-latex and urea resin.

11. The paper film of claim 1, wherein the base paper is impregnated with 5–15% wt. of the impregnating resin based on the weight of the base paper.

* * * * *